United States Patent [19]

Ueda

[11] 4,028,880

[45] June 14, 1977

[54] LIFE DISPLAY DEVICE OF A CELL INCORPORATED INTO AN ELECTRONIC TIMEPIECE

[75] Inventor: Takashi Ueda, Tokyo, Japan

[73] Assignee: Kabushiki Kaisha Daini Seikosha, Japan

[22] Filed: Dec. 19, 1975

[21] Appl. No.: 642,338

[30] Foreign Application Priority Data

Dec. 25, 1974 Japan ..... 50-3562

[52] U.S. Cl. ..... 58/23 BA; 58/23 D; 58/152 H; 340/249

[51] Int. Cl.[2] ..... G04C 3/00; G08B 21/00

[58] Field of Search ..... 58/23 BA, 23 D, 152 H; 320/13, 14; 340/248, 249

[56] References Cited

UNITED STATES PATENTS 3,898,790 8/1975 Takamune et al. ..... 58/152 H

*Primary Examiner*—E. S. Jackmun

*Attorney, Agent, or Firm*—Robert E. Burns; Emmanuel J. Lobato; Bruce L. Adams

[57] ABSTRACT

An electronic timepiece powered during use by a cell comprises an oscillating circuit for generating a high frequency output signal and a multi-stage divider circuit for receiving the high frequency output signal and dividing it at successive stages to lower frequency output signals and providing at its last stage standard pulses suitable as a time standard. A first gate circuit receives the divided signals and gates therethrough higher frequency pulses than that of the standard pulses. A control pulse generating circuit generates a given number of control pulses having a predetermined pulse width in successive predetermined periods, and a second gate circuit receives at its input both the higher frequency pulses and the control pulses and gates therethrough a number of higher frequency pulses corresponding in number to the predetermined period within the duration of the predetermined pulse width. A timing device responds to pulses applied thereto for indicating time, and a voltage detecting circuit detects the cell output voltage and provides one signal when the cell voltage is above a predetermined voltage level and another signal when the cell voltage drops below this level. A third gate circuit connected to the voltage detecting circuit responds to the one signal and gates the standard pulses to the timing device and responds to the other signal and gates the higher frequency pulses to the timing device. The timing device indicates the time in the normal manner in response to the standard pulses and in a periodic abnormal manner in response to the higher frequency pulses thereby signifying to the user that the cell is near exhaustion and needs replacement.

6 Claims, 3 Drawing Figures

LIFE DISPLAY DEVICE OF A CELL INCORPORATED INTO AN ELECTRONIC TIMEPIECE

BACKGROUND OF THE INVENTION

This invention relates to a cell consumption display device of a cell incorporated into an electronic timepiece.

Conventional electronic watches having a power cell as a or battery power source continue to work stably more than one year after the cell is replaced, because these watches employ electronic circuits having extremely low power consumption.

However, when the voltage of the cell has dropped by exhaustion, the electronic circuits of the watch are apt to work improperly and eventually the watch can not continue to operate. It is customary for the user to replace the cell after the watch mis-operates or after stop of the watch. But then it is too late to replace the cell as the watch no longer is keeping accurate time.

OBJECT OF THE INVENTION

Therefore the primary object of the invention is to provide a cell consumption display device for a cell incorporated into an electronic timepiece.

The consumption or approaching exhaustion of the cell can be notified by the irregular movement of the second hand when the terminal voltage of the cell has dropped under a predetermined voltage level.

SUMMARY OF THE INVENTION

According to the present invention, the life of a cell can be notified by irregular movement of the second hand. However, since the timepiece still keeps correct time at this stage, the cell in the timepiece may be replaced thereafter.

BRIEF DESCRIPTION OF THE INVENTION

The above mentioned and further objects, features and advantages of the present invention will become more obvious from the following description when taken in connection with the accompanying drawings, which show one preferred embodiment of the invention.

DETAILED DESCRIPTION OF THE INVENTION

Figure 1:
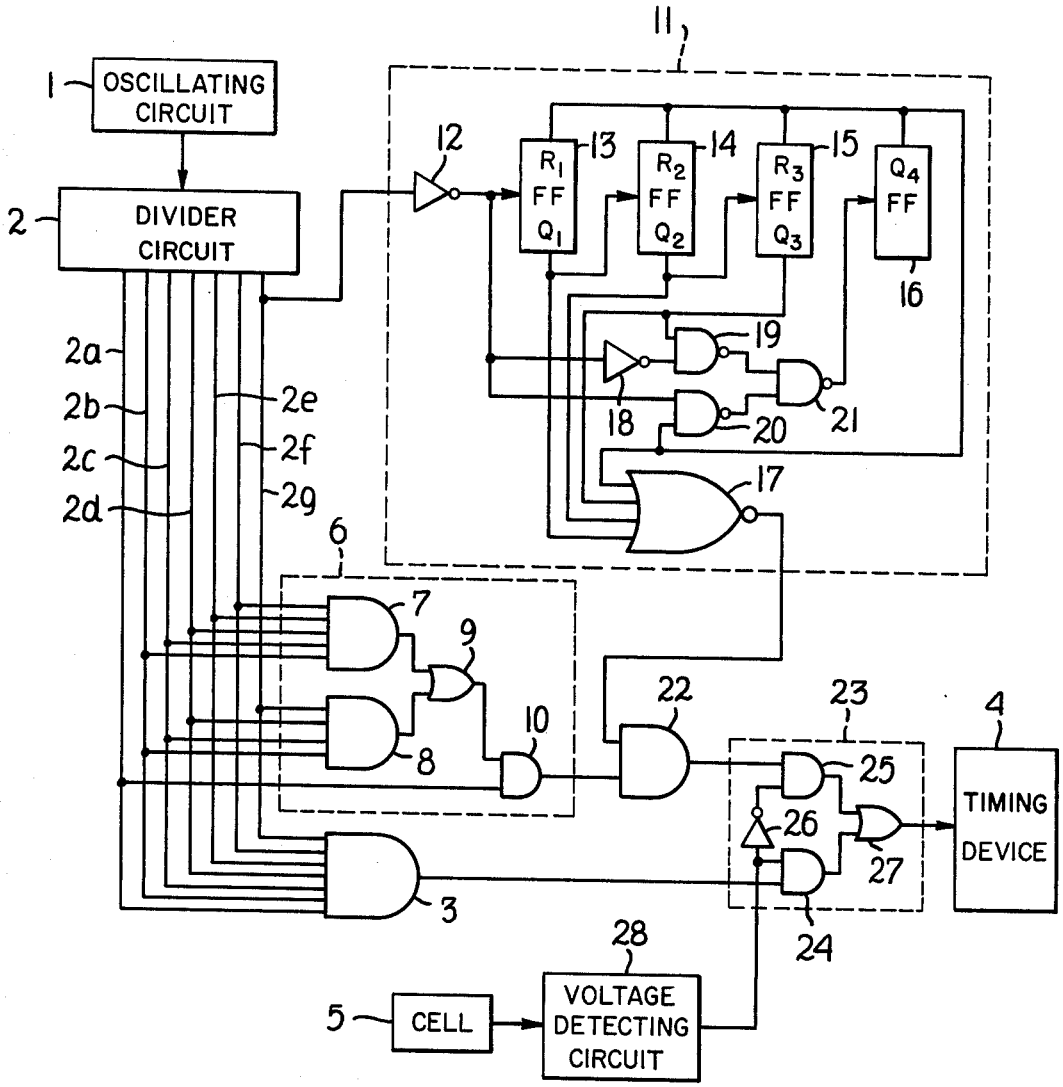
FIG. 1 is a circuit diagram showing an embodiment of this invention.

Now referring to FIG. 1, the output frequency of the oscillating circuit is 32,768 Hz and is divided by the multistage divider circuit 2 having fifteen divider stages, and each divider stage divides by two the incoming signal and delivers a corresponding divided output signal. Output terminals from the ninth divider stage to the fifteenth divider stage of the divider circuit 2 whose ouput frequencies are 64 Hz, 32 Hz, 16 Hz, 8 Hz, 4 HZ, 2 Hz and 1 Hz are connected to AND gate circuit 3 via lines 2*a*–2*g* respectively.

A time standard pulse train having a pulse width of 7.8 msec. and a period of 1 sec. comes out from AND gate circuit 3, and is supplied to the timing device 4 ordinarily via AND gate circuit 24 and OR gate circuit 27 which form part of a third gate circuit 23 which will be described hereinafter. The timing device 4 includes a motion converter such as a stepping motor and a driving circuit which generates plus and minus pulses corresponding to the time standard pulses for driving the motion converter. Since one pulse is supplied to the stepping motor in every second, the second hand (not shown) is driven one increment in each second so long as the output voltage of the cell 5 is sufficient.

A first gate circuit 6 consists of AND gate circuits 7, 8 and 10, and an OR gate circuit 9. Output terminals from the tenth divider stage to the fourteenth divider stage of the divider circuit 2 are connected to AND gate circuit 7 via lines 2*b*–2*f* respectively, and output terminals from the tenth divider stage to the twelfth divider stage and the fifteenth divider stage of the divider circuit 2 are connected to AND gate circuit 8 via lines 2*b*–2*d* and 2*g* respectively.

Output terminals of both AND gate circuits 7 and 8 are connected to OR gate circuit 9, and its output terminal is connected to AND gate circuit 10. The other input terminal of AND gate circuit 10 is connected to the ninth divider stage of the divider circuit 2 via line 2*a*.

Figure 2:
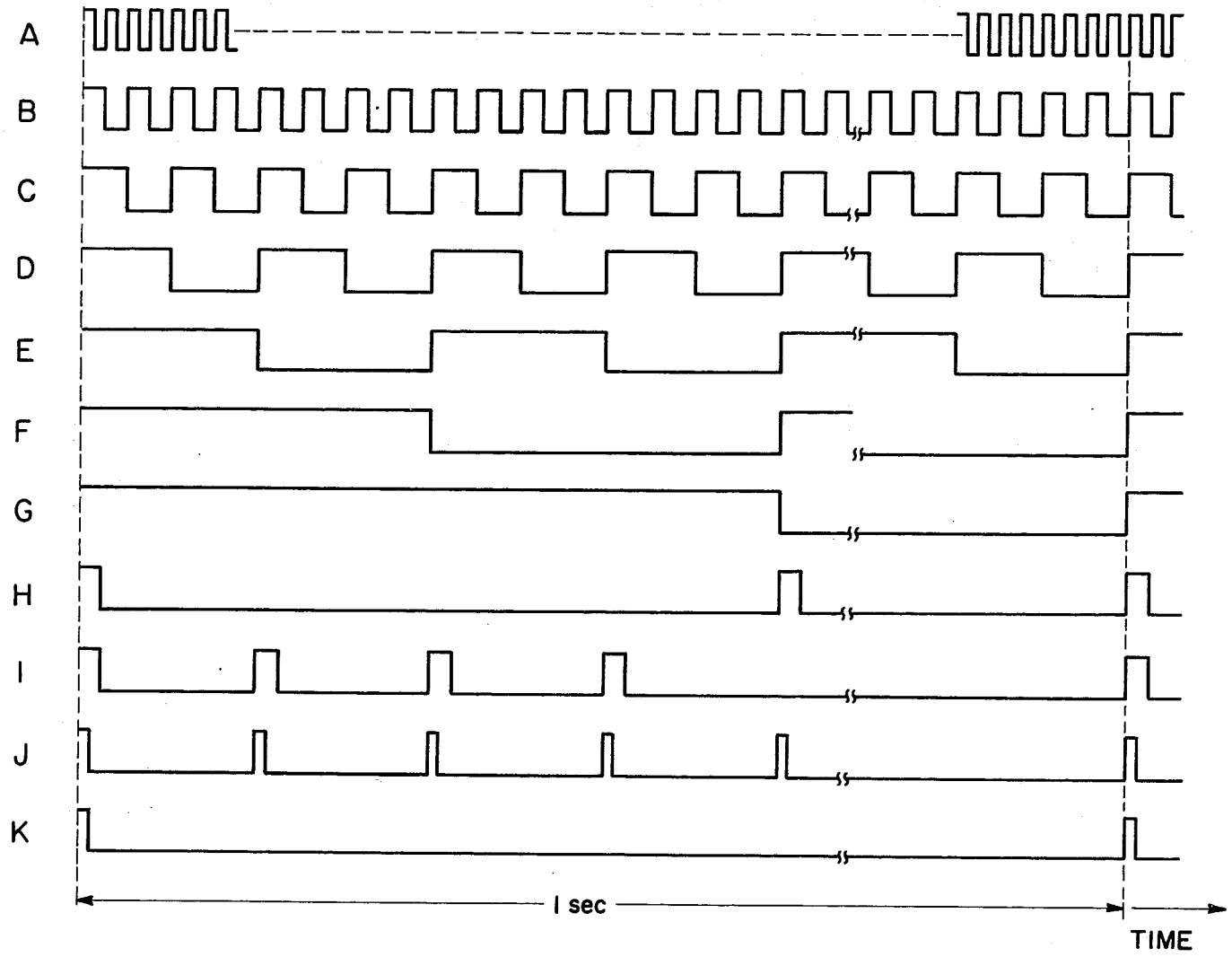
FIGS. 2 and 3 show wave forms which explain the function of the circuit.

Referring to FIG. 2, the function of the first gate circuit 6 is explained. Output signals from the ninth divider stage to the fifteenth divider stage of the divider circuit 2 correspond to wave forms A, B, C, D, E, F and G of which frequencies are 64 Hz, 32 Hz, 16 Hz, 8 Hz, 4 Hz, 2 Hz and 1 Hz respectively. Input signals of AND gate circuit 7 are the pulse trains shown by wave forms B to F. The output signal of the circuit 7 is shown by the wave form H having two pulses per one second with a pulse width of 15.6 msec. Input signals of AND gate circuit 8 are the pulse trains shown by wave forms B, C, D, and G, and its ouput signal is shown by the wave form I having four pulses per one second and the pulse width is also 15.6 msec.

Output signals of AND gate circuits 7 and 8 are supplied to OR gate circuit 9 and the output signal of OR gate circuit 9 is supplied to one of the input terminal of AND gate circuit 10. The pulse train shown by wave form A is supplied to the other input terminal of AND gate circuit 10 and its output signal is shown by the wave form J having five pulses per one second and a pulse width of 7.8 msec which is equal to that of 64 Hz pulse train.

The pulse train of 5 Hz from the first gate circuit 6 appears at each first half second, but it is possible to make it appear at each latter half second by changing the circuit configurations. This 5 Hz pulse train is hereinafter referred to as the higher frequency pulse train as compared to the output pulse train (the time standard pulse train of 1 Hz) from AND gate circuit 3.

The control-pulse generating circuit 11 comprises an inverter 12 which receives the 1 Hz pulse train from the last divider stage of the divider circuit 2*a*, 4-bit counter which carries one unit in every five pulses and this counter has four flip-flop circuits 13, 14, 15 and 16 and receives output signals from the inverter 12, a NOR gate circuit 17 which receives output signals from respective flip-flop circuits 13 – 16, an inverter 18, and three NAND gate circuits 19, 20 and 21.

The output terminal Q of the first flip-flop circuit 13 is connected to the input terminal of the second flip-flop circuit 14 and one of the input terminals of NOR gate circuit 17. The output terminal $Q_2$ of the second flip-flop circuit 14 is connected to input terminals of the third flip-flop circuit 15 and one of the input terminals of NOR gate circuit 17. The output terminal $Q_3$ of the third flip-flop circuit 15 is connected to one of the input terminals of NAND gate circuit 19 and one of the input terminals of NOR gate circuit 17. The output terminal $Q_4$ of the fourth flip-flop circuit 16 is connected to reset terminals $R_1$, $R_2$ and $R_3$ of respective flip-flop circuits 13 – 15, one of the input terminals of NOR gate circuit 20, and one of the input terminals of NOR gate circuit 17.

The output terminal of the inverter 12 is connected to the input terminal of the inverter 18 and the other input terminal of NAND gate circuit 20. The output terminal of the inverter 18 is connected to the other input terminal of NAND gate circuit 19. The output terminals of NAND gate circuit 21 are connected to both input terminals of NAND gate circuit 21 respectively and its output terminal is connected to the input terminal of the fourth flip-flop circuit 16.

Figure 3:
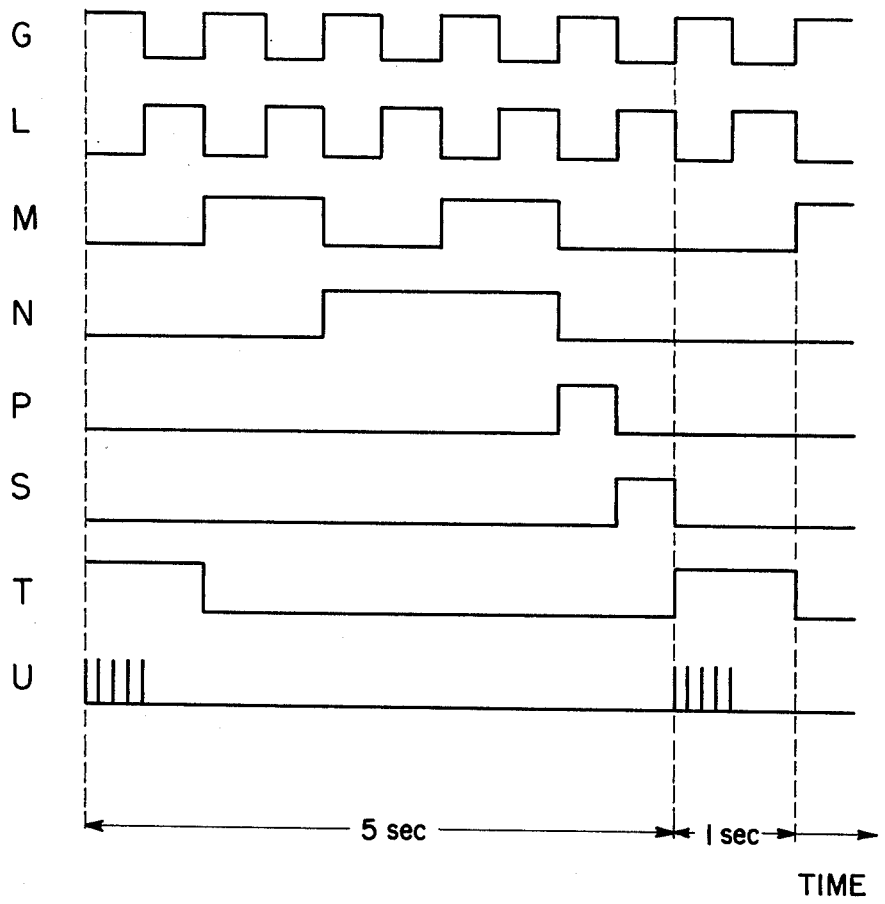

The construction of the control pulse generating circuit 11 is such that the function of this circuit is explained referring to FIG. 3.

When 1 Hz time standard pulse train G is supplied to the inverter 12, it is reversed by the inverter 12 and becomes like the wave form L. This wave form L is supplied to the 4-bit counter having four flip-flops 13 – 16, the inverter 18 and NAND gate circuit 20. As a result, the wave form M comes out from the flip-flop 13, the wave form N comes out from the flip-flop 14, the wave form P comes out from the flip-flop 15 and the wave form S comes out from the flip-flop 16.

Since wave forms M, N, P and S are supplied to NOR gate circuit 17, the wave form T which is the output signal of NOR gate circuit 17 comes out from the control pulse generating circuit 11 and this output signal is referred to hereinafter as a control signal or control pulses. The pulse width of the wave form T is one second and its cycle is five seconds. Both the control pulses from the control pulse generating circuit 11 and the higher frequency pulse train from the first gate circuit 6 are supplied to the input terminals of AND gate circuit 22 acting as the second gate circuit.

As mentioned above, since five pulses come out from the first gate circuit 6 in every second and one pulse whose pulse width is one second comes out from the control pulse generating circuit 11 in every five seconds, five pulses which are generated in the first half second appear as the output from the second gate circuit 22 in every five seconds as shown in the wave form U.

The third gate circuit 23 consists of AND gate circuits 24 and 25, an inverter 26 and an OR gate circuit 27. The output terminal of AND gate circuit 3 is connected to one of the input terminals of AND gate circuit 24, and the output terminal of the voltage detecting circuit 28 for a cell 5 is connected to the other input terminal of AND gate circuit 24 and to the inverter 26. The output terminal of the second gate circuit 22 is connected to one of the input terminals of AND gate circuit 25 and the output terminal of the inverter 26 is connected to the other input terminal of AND gate circuit 25. Both output terminals of AND gate circuit 24 and 25 are connected to the input terminal of OR gate circuit 27 respectively, and its output terminal is connected to the timing device 4.

The voltage detecting circuit 28 generates a high level signal in case the cell 4 keeps sufficient voltage when the capacity of the cell is not yet exhausted, and generates a low level signal in case the voltage of the cell 5 drops less than the predetermined voltage level when the life of the cell is almost exhausted. In other words, the third gate circuit 23 is controlled by a voltage detecting circuit 28.

When a high level signal comes out from the voltage detecting circuit 28, such denotes that the voltage of the cell 5 is more than the predetermined value, and the time standard pulse train of 1 Hz from AND gate circuit 3 is supplied to the timing device 4 via AND gate circuit 24 and OR gate circuit 27. Then the displayed time changes in the usual way, in other words, the second hand is moved in one step increments once each second.

When the voltage of the cell 5 drops below the predetermined level because the life of the cell 5 is almost exhausted, a low level signal comes out from the voltage detecting circuit 28. The low level signal is supplied to the inverter 26 and the inverted high level signal is supplied to one input terminal of AND gate circuit 25. Then the high speed pulse train from the second gate circuit 22 whose wave form is shown in FIG. 3(U) is supplied to the timing device 4 via AND gate circuit 25 and OR gate circuit 27 instead of the time standard pulse train.

As a result, the second hand of the timepiece moves an amount equivalent to five seconds in one second and after that it remains stationary or stopped during the following four seconds. Though the movement of the second hand is irregular at this moment, the indicated time is kept correct. Seeing this irregular movement of the second hand, the person carrying the timepiece is able to know that the life of the cell is almost exhausted.

According to the embodiment of this invention, the control pulse-generating circuit 11 functions as a quintile counter (a counter which takes a figure up one unit when the counter receives every five pulse) and generates one control pulse having the pulse width of one second in every five seconds. However, it is not limited to the quintile counter, and it is possible to employ other counters such as a decimal counter. In this case, one control pulse is generated in every ten seconds, and ten high speed pulses are supplied to the timing device 4 in the first one second and no pulse is supplied thereto in the following nine seconds. The counter is used for generating control pulses in this embodiment, but it may be replaced by gate circuits which are connected to each divider stage of the divider circuit 2.

The timing device has an analogue display device in this embodiment, but it may be replaceable by digital display device such as liquid crystal display device incorporating a second counter, a minuite counter, an hour counter, a decoder circuit, a driver circuit etc.. In this case, the life of a cell may be notified by an irregular change of the display instead of irregular movement of the second hand.

Although the invention has been shown in connection with a certain specific embodiment it will be readily apparent to those skilled in the art that various changes in form and arrangement of parts may be made to suit requirements without departing from the spirit and scope of the invention.

I claim:

1. In an electronic timepiece powered during use by a cell: an oscillating circuit for generating a high frequency output signal; a multi-stage divider circuit connected to said oscillating circuit for receiving therefrom the high frequency output signal and dividing it at successive stages to lower frequency output signals and providing at its last stage standard pulses suitable as a time standard; first gate circuit means connected to the stages of said multi-stage divider circuit for receiving the divided signals therefrom and gating therethrough higher frequency pulses than that of said standard pulses; control pulse generating circuit means for generating a given number of control pulses having a predetermined pulse width in successive predetermined periods; second gate circuit means connected to receive at its input both the higher frequency pulses and said control pulses and operative to gate therethrough a number of higher frequency pulses corresponding in number to said predetermined period within the duration of said predetermined pulse width; a timing device responsive to pulses applied thereto for indicating time; voltage detecting circuit means connected to the cell for detecting the cell output voltage and providing one signal when the cell voltage is above a predetermined voltage level and another signal when the cell voltage drops below said predetermined voltage level; and third gate circuit means responsive to said one signal for gating said standard pulses to said timing device and responsive to said another signal for gating said higher frequency pulses to said timing device.

2. An electronic timepiece according to claim 1; wherein said timing device comprises analogue display means for indicating the time in analogue form.

3. An electronic timepeice according to claim 2; wherein said analogue display means includes a movable second hand, and means for rotationally driving said second hand in an incremental manner in response to pulses applied to said timing device such that said second hand moves a numer of increments equal to said number of higher frequency pulses gated through said second gate circuit means within the duration of said predetermined pulse width and thereafter remains stationary until said second gate circuit means again gates higher frequency pulses therethrough thereby indicating to the user that said cell is near exhaustion and needs replacement.

4. A cell consumption display device for a power cell incorporated into an electronic timepiece comprising: an oscillating circuit comprised of quartz crystal vibrator or the like; a divider circuit having a plurality of divider stages which divide output signals from said oscillating circuit and operative to generate a time standard pulse train; a timing device connected to receive said time standard pulse train and indicate present time; a cell which supplies electric energy to said circuits and said device; a first gate circuit connected to said divider circuit and operative to transmit a higher frequency pulse train higher than that of said time standard pulse train; a control pulse generating circuit including a counter and operative to generate control pulses having a predetermined pulse width in every predetermined period; a second gate circuit operative to transmit a number of higher frequency pulses corresponding to said predetermined period within the duration of said predetermined pulse width; and a third gate circuit operative to selectively transmit said time standard pulse train or said higher frequency pulse train to said timing device in dependence upon the output voltage level of said cell.

5. A cell consumption display device of a cell incorporated into an electronic timepiece according to claim 4; said third gate circuit having means connected to receive both the output signal of said second gate and said time standard pulse train and operative to transmit said time standard pulse train to said timing device when the output voltage level of said cell is above a predetermined level and to transmit said higher frequency pulse train to said timing device when the output voltage level of said cell drops below said predetermined level.

6. A cell consumption display device of a cell incorporated into an electronic timepiece according to claim 5; wherein said timing device includes analogue display means including a movable second hand which moves an amount of five seconds and thereafter remains stationary during the following four seconds when the voltage of said cell drops below said predetermined level.

* * * * *